US006024505A

United States Patent [19]

Shinohara

[11] Patent Number: 6,024,505

[45] **Date of Patent: *Feb. 15, 2000**

[54] PRINTING SYSTEM

[75] Inventor: Hiroshi Shinohara, Nagano, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/948,784

[22] Filed: Oct. 10, 1997

[30] Foreign Application Priority Data

Oct. 22, 1996 [JP] Japan ..... 8-279302

[51] Int. Cl.[7] ..... B41J 11/50; B41J 11/44

[52] U.S. Cl. ..... 400/605; 400/76; 395/117; 707/102; 707/505; 707/509; 345/961

[58] Field of Search ..... 400/76, 83, 605, 400/611, 616, 615.2; 364/468.24; 395/112, 113, 114, 117; 707/102, 505, 509; 345/961

[56] References Cited

U.S. PATENT DOCUMENTS

| | | | |
|---|---|---|---|
| 4,778,288 | 10/1988 | Nakamura | 400/76 |
| 4,846,597 | 7/1989 | Bryant et al. | 400/83 |
| 4,899,136 | 2/1990 | Beard et al. | 400/76 |
| 5,075,874 | 12/1991 | Steeves et al. | 395/112 |
| 5,214,750 | 5/1993 | Minowa et al. | 400/605 |
| 5,431,505 | 7/1995 | Kato et al. | 400/83 |
| 5,483,889 | 1/1996 | Hoberock et al. | 101/232 |
| 5,584,590 | 12/1996 | Ito et al. | 400/605 |
| 5,584,591 | 12/1996 | Mori et al. | 400/615.2 |
| 5,594,653 | 1/1997 | Akiyama et al. | 364/468.24 |
| 5,639,169 | 6/1997 | Aruga | 400/605 |
| 5,639,171 | 6/1997 | Brewster, Jr. et al. | 400/605 |
| 5,699,494 | 12/1997 | Colbert et al. | 395/112 |
| 5,799,206 | 8/1998 | Kitagawa | 395/112 |
| 5,816,716 | 10/1998 | Sugiyama | 400/605 |
| 5,828,818 | 10/1998 | Awzai | 395/117 |

FOREIGN PATENT DOCUMENTS

| | | |
|---|---|---|
| 0 331 329 A1 | 9/1989 | European Pat. Off. . |
| 0 486 031 A2 | 5/1992 | European Pat. Off. . |

OTHER PUBLICATIONS

English language Abstract, JPA 03090377, published Apr. 16, 1991.

English language Abstract, JPA 08185294, published Jul. 16, 1996.

*Primary Examiner*—Eugene Eickholt

*Attorney, Agent, or Firm*—Sughrue, Mion, Zinn, Macpeak & Seas, PLLC

[57] ABSTRACT

A printing system in which different types of printing media are each selectively used for printing, making it easy for the user to check the type of printing medium set in a printer, to change the printing medium set in the printer to another type of printing media, and to set printer setup values for each printing medium. The printing system includes a printer (1) and at least one host computer (3). Different types of form sheets are set in the sheet paths of the printer (1). Form sheet data is registered in a memory of the printer (1). The form sheet data contains the names and size values of the form sheets, sheet paths, presence or absence of a desired form sheet. A printer checker (3) fetches form sheet data from the printer (1), and loads it into a register (33). A printer customizer (35) has the functions to push the form sheet data out of the register (33) and visually present it on a monitor screen (25), to send new form sheet data to the printer (1) and register it in the memory of the printer, and to recognize a form sheet selected by the user as a form sheet, to be used for printing.

18 Claims, 9 Drawing Sheets

FIG.3

| SHEET No. | FORM SHEET NAME | SHEET PATH | KIND OF SHEET | CURRENT SELECTION STATUS | PRINTER SETUP VALUES |
|---|---|---|---|---|---|
| 0 | (NONE) | ..... | ..... | ..... | ..... |
| 1 | PURCHASING SHEET B | FRONT CONTINUOUS FORM | | ○ | |
| 2 | WAGE SHEET | REAR CONTINUOUS FORM | | ◎ | |
| 3 | | | | | |
| 4 | PURCHASING SHEET C | REAR MANUAL INSERTION | | ○ | |
| 5 | DELIVERY SHEET | CSF BIN 1 | | ○ | |
| 6 | | | | | |
| 7 | RECEIPT | FRONT MANUAL INSERTION | | ○ | |
| 8 | PURCHASING SHEET A | CSF BIN 2 | | ○ | |

FIG.5

| SHEET No. | FORM SHEET NAME | SHEET PATH | CURRENT SELECTION STATUS |
|---|---|---|---|
| 0 | (NONE) | ..... | ..... |
| 1 | PURCHASING SHEET B | FRONT CONTINUOUS FORM | ○ |
| 2 | WAGE SHEET | REAR CONTINUOUS FORM | ◎ |
| 3 | | | |
| 4 | PURCHASING SHEET C | REAR MANUAL INSERTION | ○ |
| 5 | DELIVERY SHEET | CSF BIN 1 | ○ |
| 6 | | | |
| 7 | RECEIPT | FRONT MANUAL INSERTION | ○ |
| 8 | PURCHASING SHEET A | CSF BIN 2 | ○ |

FIG.8

| SHEET No. | FORM SHEET NAME | SHEET PATH |
|---|---|---|
| 0 | (NONE) | ..... |
| 1 | PURCHASING SHEET B | FRONT CONTINUOUS FORM |
| 2 | WAGE SHEET | REAR CONTINUOUS FORM |
| 3 | | |
| 4 | PURCHASING SHEET C | REAR MANUAL INSERTION |
| 5 | DELIVERY SHEET | CSF BIN 1 |
| 6 | | |
| 7 | RECEIPT | FRONT MANUAL INSERTION |
| 8 | PURCHASING SHEET A | CSF BIN 2 |

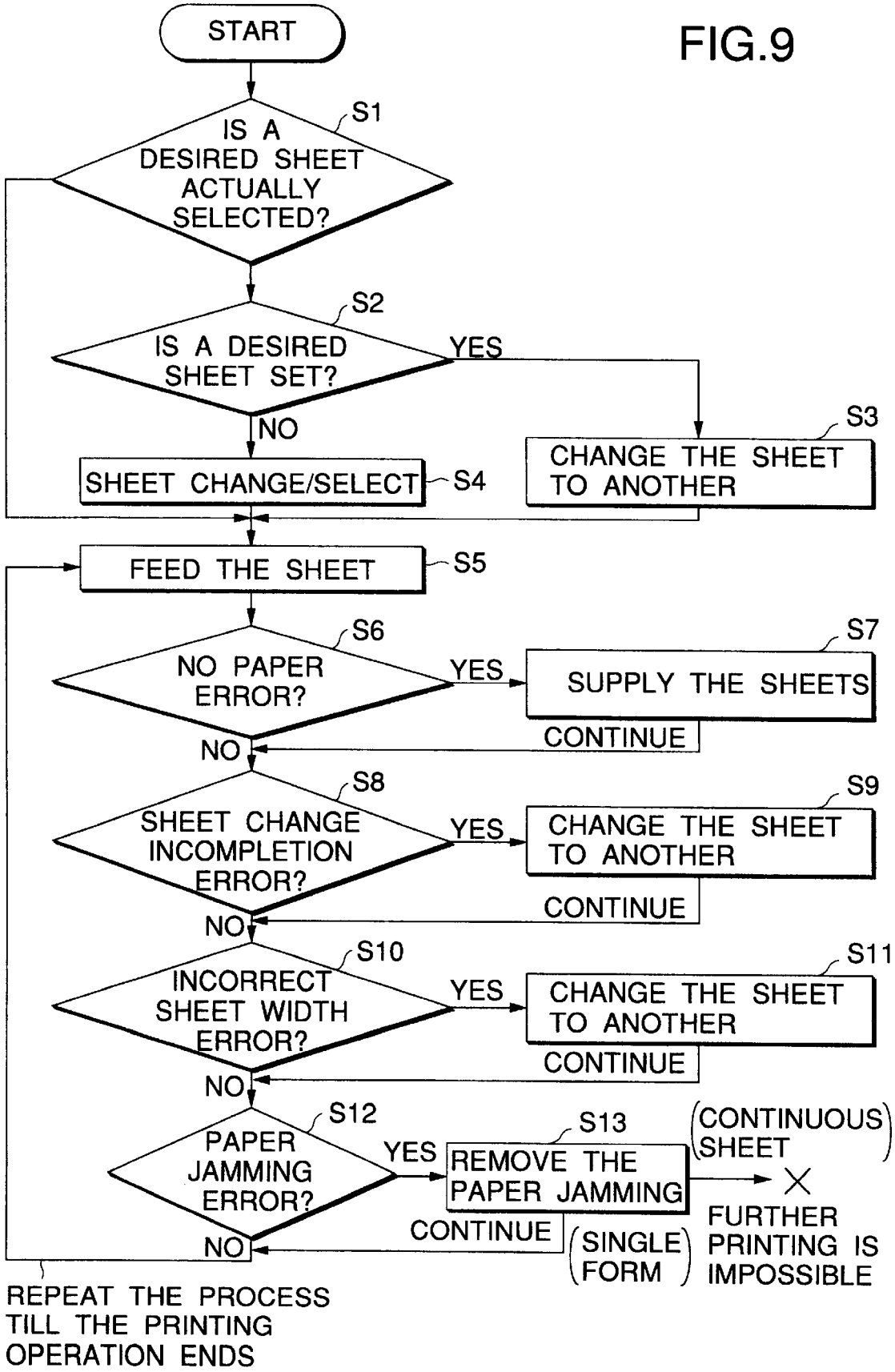
FIG.9
START
S1
IS A DESIRED SHEET ACTUALLY SELECTED?
S2
IS A DESIRED SHEET SET?
YES
NO
S3
CHANGE THE SHEET TO ANOTHER
SHEET CHANGE/SELECT
S4
FEED THE SHEET
S5
S6
NO PAPER ERROR?
YES
S7
SUPPLY THE SHEETS
CONTINUE
NO
S8
SHEET CHANGE INCOMPLETION ERROR?
YES
S9
CHANGE THE SHEET TO ANOTHER
CONTINUE
NO
S10
INCORRECT SHEET WIDTH ERROR?
YES
S11
CHANGE THE SHEET TO ANOTHER
CONTINUE
NO
S12
PAPER JAMMING ERROR?
YES
S13
REMOVE THE PAPER JAMMING
(CONTINUOUS SHEET)
FURTHER PRINTING IS IMPOSSIBLE
CONTINUE
(SINGLE FORM)
NO
REPEAT THE PROCESS TILL THE PRINTING OPERATION ENDS

PRINTING SYSTEM

BACKGROUND OF THE INVENTION

1. Field of the Invention

This invention relates to a printing system of the type in which plural types of printing media, e.g., form sheets, are set in a printer, and in printing, a desired printing medium is selected from among these printing media.

2. Background

In the printing of form sheets, difficulty arises in that the form sheets are different in sheet size value, type of sheet (regular sheet, cardboard, envelope, postcard or the like), setup values (sheet feeding quantity, gap length between head and platen and the like), sheet paths (bin, sheet tray, sheet tractor, and the like), and the like. A sole prior technique to check the types of printing media, e.g., sheets of paper, set in the printer, more exactly the sheet paths, is that a user actually checks the sheets set in the printer by the eye. A known technique to select a printing medium to be used for printing from among plural types of printing media set in the printer is to designate a medium or sheet path having the selected printing medium set therein by the host computer coupled with the printer. The printing medium selecting technique requires the user to check the types of sheets set in the sheet paths of the printer in advance. When the technique is used, every time the printing medium used for printing is selected, the user must change the printer setup values to the values tailored to the selected printing medium. The setup value changing work is troublesome for the user. Particularly, in a computer environment where a plurality of users use a single printer in share on a network, the problem is more serious since a place where the printer is located is remote from users or the form sheet for one user is different from for another user.

SUMMARY OF THE INVENTION

Accordingly, an object of the present invention is to provide a printing system using plural types of printing media in which it is easy to check the types of printing media set in the printer, to change a type of printing media set in the printer to another, and to change the printer setup values, which are set for every printing medium, to other ones.

According to the present invention, there is provided a printing system having a printer to which plural types of printing media may be set, comprising:

storing means for storing medium data representative of the types of printing media set in the printer;

information visual presenting means for visually presenting the medium data stored in the storing means to the user; and medium selecting means for selecting a printing medium from among printing media set in the printer in response to a select instruction by the user and sending the selection of the printing medium to the printer.

In the printing system thus constructed, the types of printing media, e.g., form sheets, set in the printer are visually presented to the user. The user sees those types of the displayed form sheets and selects his desired form sheet from those form sheets and sends a message of the selection of the desired form sheet to the printer. Therefore, the user can select his desired form sheet without directly checking the form sheet in the printer.

In a preferred embodiment of the invention, the medium or form sheet data contains the information of sheet size, sheet path, form sheet being selected or not, and the like. It is noted that the names of form sheets are visually presented or displayed. This feature makes it easy for the user to select his desired form sheet. Additionally, in the printing system, the form sheet being currently selected is displayed. This feature also assists the user in selecting his desired form sheet.

In another preferred embodiment of the invention, the medium or form sheet data contains printer setup values. Therefore, when a form sheet is chosen, the printer setup values of the chosen form sheet are automatically transferred from the information storing means, e.g., a memory, to the printer and set in the printer. This feature eliminates such a troublesome work by the user that every time the form sheet is selected, the user inputs the printer setup values to the printer.

In still another preferred embodiment of the present invention, the form sheet data contains size data of the form sheets. Therefore, the printer checks whether or not the size indicated by the size data of the selected form sheet is coincident with the size of an actual form sheet. With this function of the printer, even if an incorrect form sheet is set in the printer, it never happens that the printer erroneously prints on the incorrect form sheet. Besides, if any of the size of the size data, the size of an actual form sheet, and the sheet size contained in print data is incorrect, the system control of the printing system judges that the sheet size is incorrect.

In yet another preferred embodiment of the invention, a printer is connected to at least one host computer in a manner that the printer and the computer bidirectionally communicate with each other. The printer includes the information storing means, e.g., a memory, while the host computer includes the information visual presenting means, e.g., a display means, and the medium select means, e.g., a form sheet select means. Alternately, the printer also includes the form sheet select means. Therefore, the user can check and select a desired form sheet by use of the host computer, and, if necessary, can select the desired form sheet on the control panel of the printer.

BRIEF DESCRIPTION OF THE DRAWINGS

FIG. 3 is a table showing the contents of a form sheet memory of the printer;

FIG. 5 is a table showing an example of the contents of a display containing a list of form sheet data, displayed on the computer monitor, when the computer is in a form sheet registration mode;

FIG. 8 is a table showing the contents of a label pasted on a location near the control panel; and FIG. 9 shows a flow of a process carried out in the sheet feed controller-portion of the printer.

DETAILED DESCRIPTION OF THE PREFERRED EMBODIMENTS

A preferred embodiment of the present invention will be described with reference to the accompanying drawings.

Figure 1:
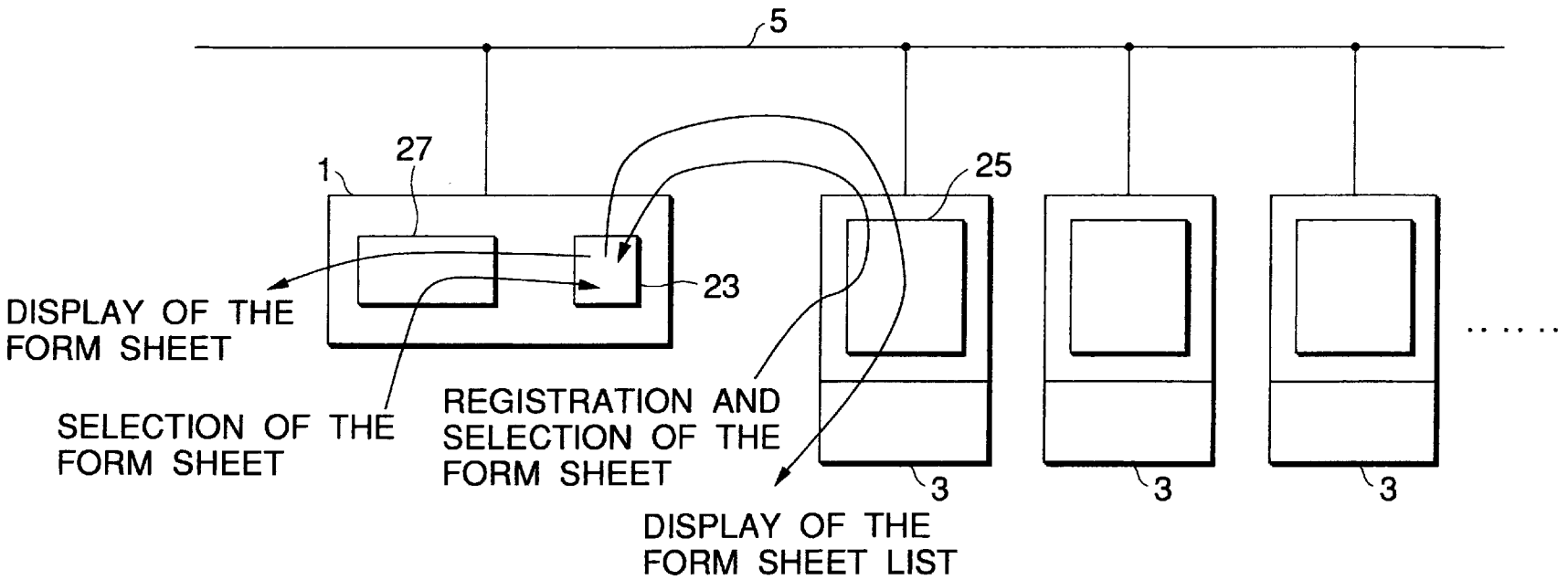
FIG. 1 is a block diagram showing a system configuration of a printing system according to an embodiment of the present invention.

As shown in FIG. 1, a single printer 1 is coupled with a plurality of host computers 3 by a communication network 5 so that those computers are accessible to the printer. The printer 1 and the host computer 3 communicate with each other bidirectionally.

Figure 2:
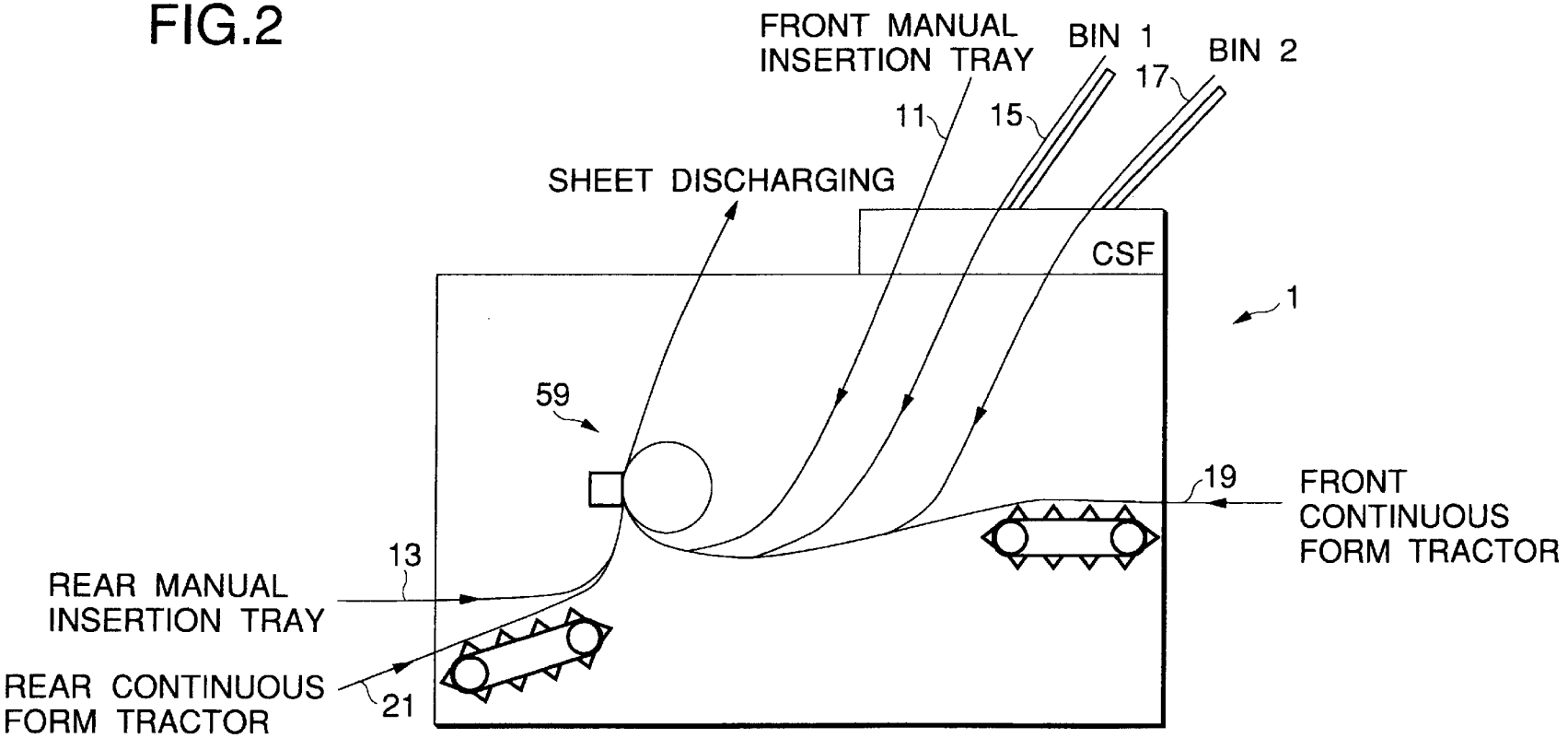
FIG. 2 is a diagram typically showing sheet paths of one of a printer in the printing system of FIG. 1.

As shown in FIG. 2, the printer 1 includes a plurality of sheet paths. Examples of these paths are a front manual insertion tray 11, a rear manual insertion tray 13, a first cut sheet feeder (CSF) bin 15, a second CSF bin 17, a front continuous form tractor 19, and a rear continuous form tractor 21. The sheet paths can receive printing media, e.g., form sheets, tailored thereto, respectively. In printing, a necessary printing medium, e.g., form sheet, may be selected from among those printing media.

Referring to FIG. 1 again, the printer 1 includes an information storing means 23, e.g., a memory (or a memory area), called a "form sheet memory". Data (to be given later) on various types of form sheets, which may be set in the sheet paths of the printer 1 are registered in the form sheet memory 23.

Each host computer 3 has the following functions:

1) to receive a list of form sheet data registered in the form sheet memory 23 from the printer 1 and to display the data list on the monitor screen 25 of the host computer 3;
2) to send new form sheet data, entered by a user, to the printer 1 in order to register the new form sheet data in the form sheet memory 23; and
3) to send an instruction to select a form sheet to be used for printing from among those form sheets set in the printer, more exactly, their sheet paths, to the printer 1 in accordance with an instruction entered by the user.

The printer 1 has the following functions:

1) to display the number of a form sheet being currently selected on a control panel 27 of the printer;
2) to select a form sheet to be used for printing from among those form sheets currently set in the printer in accordance with an instruction entered by the user, to the control panel 27 or an instruction issued from the host computer 3; and
3) to receive new form sheet data from the host computer 3 and to register the received one in the form sheet memory 23 or to read out the list of registered data from the form sheet memory 23 and send the data list to the host computer 3.

FIG. 3 shows the contents of the form sheet memory 23. A maximum of eight (8) kinds of form sheet data may be registered in the form sheet memory 23. The form sheet data contains form sheet number, form sheet name, form sheet path, form sheet size, kind of form sheet, current selection status, and printer setup values. Here, "form sheet number" and "form sheet name" indicate the number and name assigned to the form sheet by the user, respectively. "Form sheet path" indicate the CSF feeder, manual insertion tray or continuous form tractor in which form sheets are set (or may be set), as shown in FIG. 2. In a case where different form sheets are each selectively set in the same sheet path, one sheet path is assigned to those different form sheets. "Kind of form sheet" discriminately indicates regular sheet, cardboard, envelope, postcard, and the like. In the column of "current selection status" in the table, no mark indicates that no sheet is set in the sheet path specified by no mark. The marks of single and double circles indicate that form sheets are set in the sheet paths specified by these marks. Particularly, the single circle mark indicates that a type of form sheet is set to be used for printing in the printer. "Printer setup value" indicates information necessary for correctly printing the related form sheet, for example, sheet feeding position, head-to-platen gap width, and the like. The form sheet number "0" indicates that no form sheet data is registered. When it is selected, the printer performs a printing operation as the conventional printer not having the form sheet memory 23 does.

Figure 4:
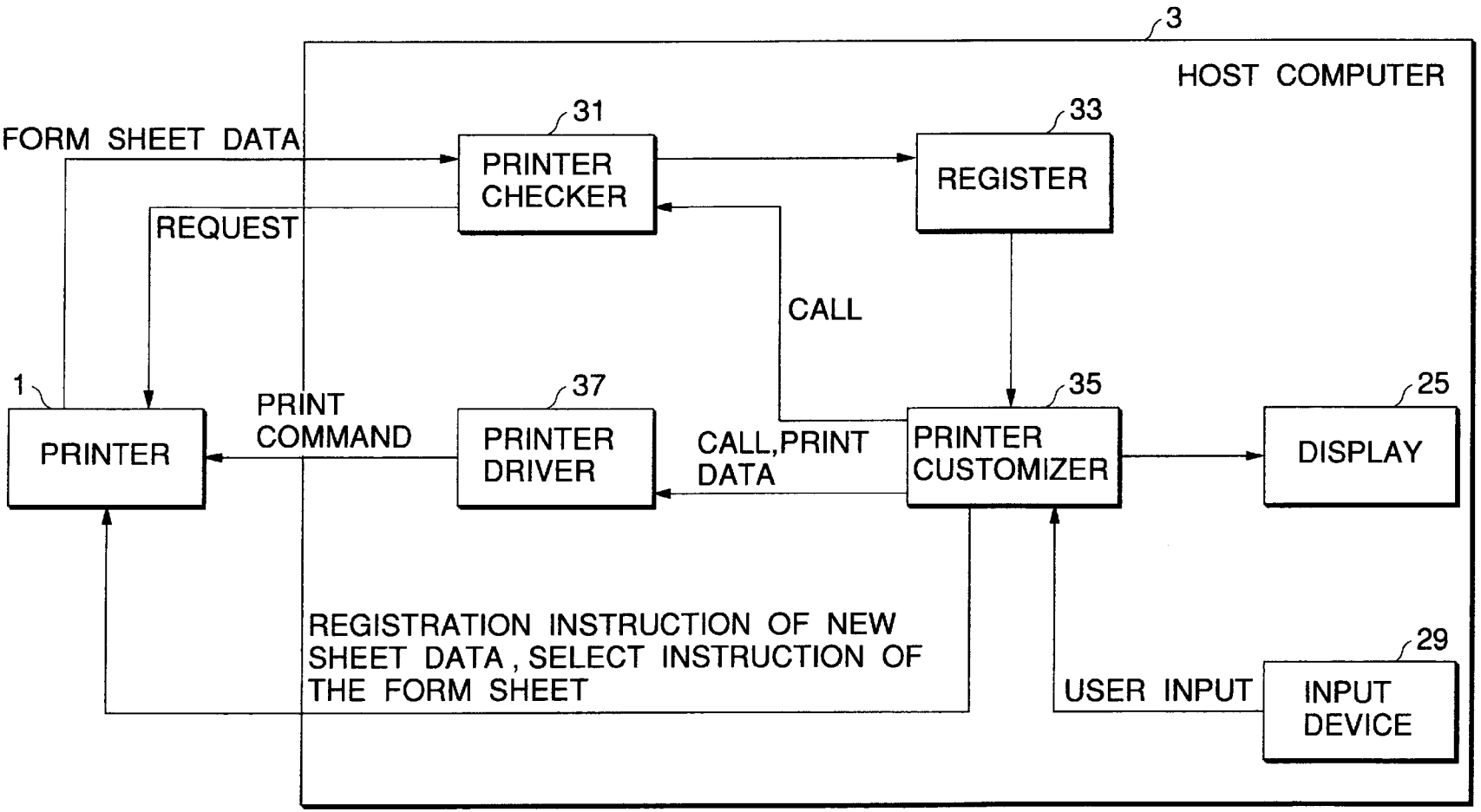
FIG. 4 is a block diagram showing a program configuration loaded into one of the host computers in the printing system.

FIG. 4 shows a program configuration of each host computer in the printing system.

In FIG. 4, a printer checker 31 sends a form sheet data request to the printer 1, receives form sheet data read out of the form sheet memory 23 from the printer 1, and loads the received one into a register 33. The printer checker 31 may be automatically executed at the time of starting up the host computer 3, proper periodical times, and the time of calling a printer driver 37.

A printer customizer 35 is a program used for registering form sheet data, selecting a form sheet, and performing a printing process. In a form sheet data registration mode, the same program reads the form sheet data from the register 33 and displays the list of form sheet data in a graphical user interface (GUI) on the monitor screen 25. The displayed form sheet data list contains, as shown in FIG. 3, all the items, for example, form sheet number, form sheet name, for sheet path, kind of form sheet, current selection status, and print setup values. The user may enter new form sheet data that he desires to register, by use of an input device 29. The printer customizer 35 sends the form sheet data entered by the user to the printer 1, and instructs the register 33 to register it into the form sheet memory 23. Thereafter, the printer customizer 35 calls the printer checker 31 and instructs the printer checker to receive the contents of the form sheet memory 23 which contains the form sheet data registered anew therein, and displays the received one in the GUI in the format as shown in FIG. 3.

In a form select mode, the printer customizer 35 reads out form sheet data from the register 33, and displays the form sheet data list on the GUI. The displayed list format contains the items useful in selecting a form sheet, such as sheet number, sheet name, sheet path, and current selection status, as shown in FIG. 5. The user sees the list and determines a form sheet to be used for printing, and inputs the resultant into his host computer. The printer customizer 35 sends to the printer 1 an instruction to select the form sheet selected by the user, and thereafter calls the printer checker 31 and instructs it to receive the contents of the form sheet memory 23 which underwent the sheet data selection, and displays the resultant on the GUI as shown in FIG. 5.

In a print mode, the printer customizer 35 calls the printer driver 37 and sends print data to the printer driver 37 and causes the driver to process the print data. The printer driver 37 has substantially the same functions as of a general print driver. The printer driver 37 carries out a necessary preprocess on the print data to convert the print data into the form of print commands in a given printer control language. The print commands are sent to the printer 1.

The form sheet data request derived from the printer checker 31, and the new form sheet data registering instruction and the form select instruction, both being derived from the printer customizer 35, are also sent to the printer 1 in the format of print commands described in printer control language.

Figure 6:
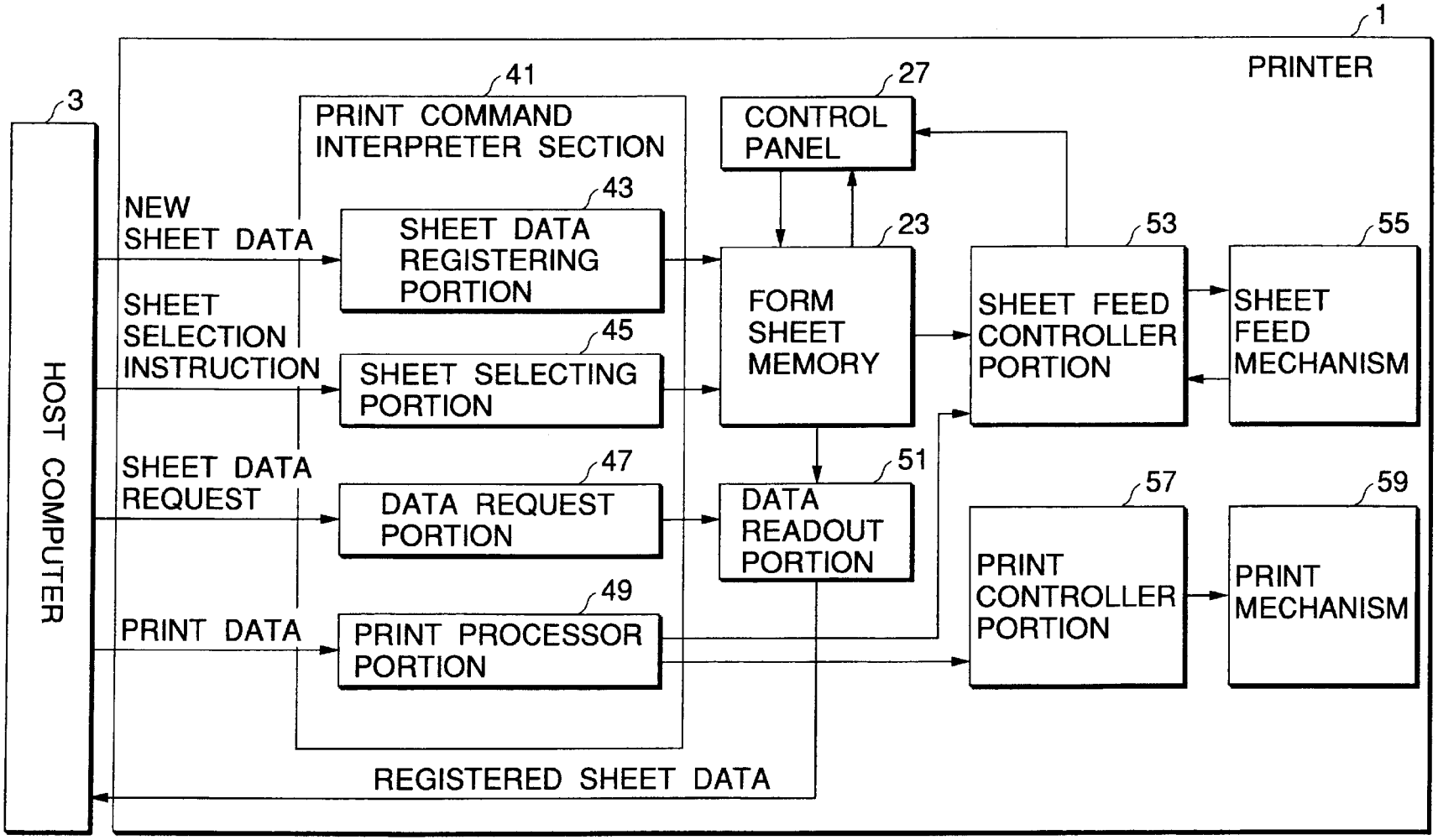
FIG. 6 is a block diagram showing a function configuration of the printer.

FIG. 6 shows in block form a function configuration of the printer 1.

In FIG. 6, a print command interpreter section 41 interprets data of the print command format, which is received from the host computer 3. As already referred to, the print command format contains the print data, and additionally the form sheet data request derived from the printer checker 31, and the new form sheet data registering instruction and the form select instruction, both being derived from the printer customizer 35. When the printer 1 receives the form sheet data request from the printer checker 31, a data request portion 47 calls a data readout portion 51, and the data readout portion 51 reads out all form sheet data from the form sheet memory 23 and sends the readout one to the host computer 3. When the printer 1 receives an instruction to register new form sheet data from the printer customizer 35 of the host computer 3, a form sheet data registering portion 43 registers the new form sheet data contained in it into the form sheet memory 23. When the printer 1 receives a sheet select signal from the printer customizer 35, a sheet selecting portion 45 replaces the contents of the "current selection status" in the form sheet memory with a status of the instructed form sheet being selected (indicated by a double circle mark).

Figure 7:
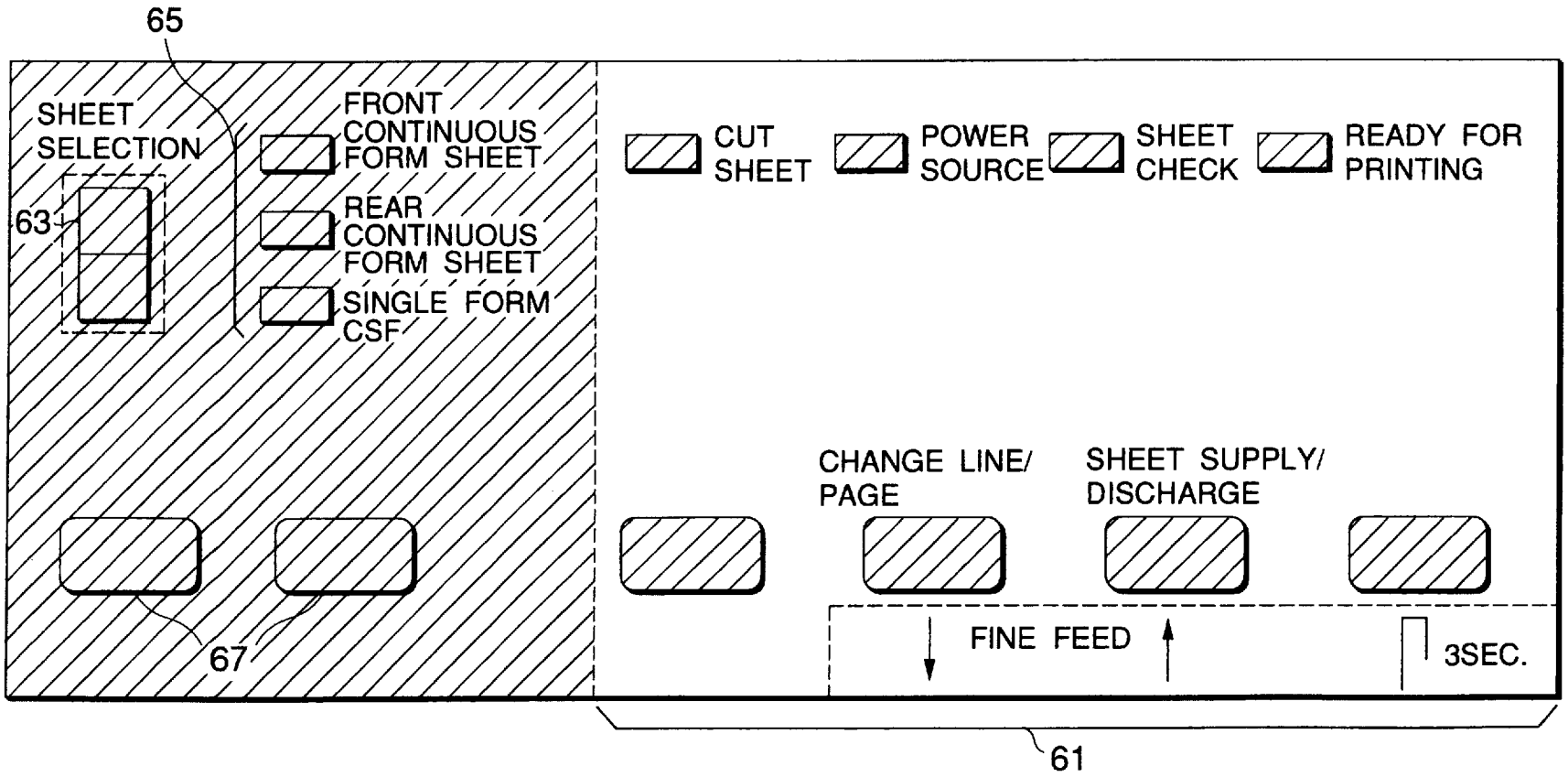
FIG. 7 is a diagram showing a layout of indicators, buttons and the like on a control panel of the printer.

As shown in FIG. 7, the control panel 27 includes, for example, indication lamps, buttons and the like indicated by reference numeral 61, a liquid crystal display (LCD) 63, path indication lamps 65, and a sheet select button 67 for selecting the form sheet. The indication lamps, buttons and the like have been included in the general printer. The path indication lamps 65 indicate those sheet paths used in this printer (front continuous form tractor 19, rear continuous form tractor 21, CSF bins 15 and 17). The control panel 27 acquires the number of the form sheet that is currently selected and read out of the form sheet memory 23, and displays it on the LCD 63, and drives a path indication lamp 65 associated with the sheet path in which the selected form sheet is set. When one of the select buttons 67 is depressed on the control panel 27, the contents of the "current selection status" in the form sheet memory 23 are rewritten so that the form sheets set in the sheet path now being selected are sequentially switched in the order of the sheet number. With the rewriting operation, the number displayed on the LCD 63 is also changed one to another in a sequential order and the path indication lamp 65 is also changed to the other. A label containing the form number, form name and sheet path as shown in FIG. 8 may be pasted on a location near the control panel 27. The label provides information useful when the user seeks his desired form sheet by use of the sheet number.

Referring again to FIG. 6, when the printer receives print data from the host computer 3, a print processor portion 49 in the print command interpreter section 41 interprets the print data to generate a print image, and transfers the print image to print controller portion 57. Further, the print processor portion 49 sends a sheet size specified by the print data and other control data necessary for sheet feeding to a sheet feed controller portion 53. The sheet feed controller portion 53 recognizes the sheet path of a form sheet currently selected while referring to the form sheet memory 23, and controls a sheet feed mechanism 55 which picks up the form sheet from the sheet path and transports the form sheet in accordance with a print setup value. The sheet feed mechanism 55 picks up a form sheet from one of the sheet paths 11 to 21, transports it to a printing mechanism of the printer, and discharges it out of the printer. The sheet feed mechanism 55 has functions to select a sheet path in accordance with a sheet path selecting instruction derived from the sheet feed controller portion 53, and to automatically detect the size of a form sheet set in the selected sheet path and send the result of the size detection to the sheet feed controller portion 53. When an error on the sheet selection and the sheet feeding is produced, the sheet feed controller portion 53 temporarily stops the remaining portion of the printer, and causes the control panel 27 to display an error message. (Examples of the error are: "the selected form sheet is not yet set", and "the sheet size of the selected form sheet is improper".)

The print controller portion 57 drives a print mechanism 59 to print a print image on the form sheet.

FIG. 9 shows a flow of a process carried out in the sheet feed controller portion 53.

The print controller portion 57 checks whether or not a form sheet (desired-form sheet) selected in the form sheet memory 23 is actually selectable in the sheet feed mechanism 55 (viz., a sheet path of the desired form sheet is ready for feeding the sheet) (S1). If the desired sheet is selectable, the sheet is picked up from the sheet path and a sheet feeding process is executed (S5). If it is not selectable, the print controller checks whether or not the desired sheet is set in the sheet path of the printer 1 (viz., the sheet path for the desired sheet is registered in the form sheet memory (23) (S2). If the desired sheet is set, a sheet path status of the sheet feed mechanism 55 is changed so that the desired sheet is selectable (S3), and then the sheet is picked up from the sheet path and a sheet feeding is carried out (S5). If it is not set, a message that the sheet is not set is displayed on the control panel 27 (additionally, it may be returned to the computer). Further, the printer control instructs the user to properly set the form sheet data in the sheet path and register it in the memory or to select the form sheet that has been set. In response to this, the user executes the instruction received (S4). Then, the sheet feeding of the desired sheet is carried out (S5).

During the execution of the sheet feeding, the sheet feed controller portion 53 monitors the occurrence of various errors, such as a no paper error, a paper change incompletion error, an incorrect sheet width error, and a paper jamming error (S6, S8, S10, S12). (The no paper error occurs when no sheet is present in the sheet path. The paper change incomplete error occurs when the paper or the form sheet is not yet changed. The incorrect sheet width error occurs when the sheet size in the form sheet memory, the sheet size designated by the print data, and the size of an actual sheet detected by the sheet feed mechanism 55 are not coincident.) If any of the errors occurs, an error message is displayed on the control panel 27 (additionally, it may be returned to the host computer). After the error is removed by the user (S7, S9, S11, S13), the execution of the sheet feeding is continued.

As seen from the foregoing description, the user can know the name of a form sheet set in a sheet path, and the sheet path per se located remotely from the printer, and select a desired form sheet from among those set in the sheet paths in accordance with the sheet name by use of his computer. When the form sheet is selected, a sheet setup value of the printer is automatically sent to the printer. Therefore, every time the user selects his desired form sheet, he does not need to enter a related setup value to the computer. When a form sheet not set is selected, or an incorrect form sheet is set, a related error message is visually presented to the user. Therefore, the user can easily know his erroneous operation from the error message.

It should be understood that the present invention may be embodied in various modes other than the above-mentioned one. For example, the invention is applicable to a case where the host computer is directly coupled with the printer in one-to-one fashion. While the form sheet memory is incorporated into the printer, it may be incorporated into the host computer or another device, such as a server. Further, the printing system may be modified such that the printer accepts through its control panel the entering of instructions to register form sheet data, to display the data list, and to select the form sheet, while the computer rejects the entering of those instructions. In this case, the system construction is simple. In a case where the computer and the printer are connected in one-to-one fashion, and the printer is located near the computer, use of such a modification will create no problem.

I claim:

1. A printing system including a printer with a plurality of sheet paths for receiving different types of printing media, comprising:

information storing means for storing at least form sheet name data, printing path data, kind of sheet data and printer setup value data, in an information table, wherein the form sheet name data is defined by other corresponding data and is adapted to be named and rearranged by a user;

information visual presenting means for visually presenting at least a portion of said information table;

selecting means for selecting a form sheet name by using said information table, which is presented by said information visual means; and printing means for printing on a form sheet according to said other data corresponding to said form sheet name, which is selected by said selecting means.

2. The printing system according to claim 1, wherein said information storing means stores information on a status of the printing media when the selected form sheet is set in a printing path, and information on a status of the printing of the selected form sheet when the form sheet is set in the printing path in a predetermined condition.

3. The printing system according to claim 1, wherein said printer includes said selecting means.

4. A printing mechanism including a printer with a plurality of sheet paths for receiving different types of printing media, comprising:

information storing means for storing printing medium data of the different types of printing media, each of the printing media being delineated by at least a printing medium path, and a name of the printing medium;

information visual presenting means for visually presenting the printing medium data including the name of the printing media, both being registered in the information storing means;

medium select means for a user to select one of the printing media stored in said information storing means by designating the name of the printing medium that is desired;

wherein the user selects the printing medium through an interactive communication with said information visual presenting means without visualizing the printer or manually changing printer setup values associated with the selected printing medium.

5. The printing system according to claim 4, wherein said printing medium data contains size information of the printing media, and said printer includes:

size detecting means for detecting an actual size of the selected printing medium; and size check means for acquiring size information of said printing media data corresponding to the selected printing medium from said information storing means in response to a message from said medium select means, and checking if the actual size of the selected printing medium acquired from said size detecting means is coincident with the size information of said printing media data.

6. A printing mechanism including a printer with a plurality of sheet paths for receiving different types of printing media, comprising:

information storing means for storing printing medium data of the different types of printing media, each of the printing media being delineated by at least a printing medium path, and a name of the printing medium;

information visual presenting means for visually presenting the printing medium data including the name of the printing media, both being registered in the information storing means:

medium select means for a user to select one of the printing media stored in said information storing means by designating the name of the printing medium that is desired;

wherein the user selects the printing medium through an interactive communication with said information visual presenting means without visualizing the printer or manually changing printer setup values associated with the selected printing medium, wherein said printing medium data contains printer setup values, further comprising:

setup means for acquiring the printer setup value corresponding to the selected printing medium from said information storing means in response to a message from said medium selecting means, and setting the printer setup value in said printer.

7. A printing system mechanism including a printer with a plurality of sheet paths for receiving different types of printing media, comprising:

informationn storing means for storing printing medium data of the different types of printing media, each of the printing media being delineated by at least a printing medium path, and a name of the printing medium;

information visual presenting means for visually presenting the printing medium data including the name of the printing media, both being registered in the information storing means;

medium select means for a user to select one of the printing media stored in said information storing means by designating the name of the printing medium that is desired;

wherein the user selects the printing medium through an interactive communication with said information visual presenting means without visualizing the printer or manually changing printer setup values associated with the selected printing medium, wherein said printing medium data contains size information of the printing media, and said printer includes:

size detecting means for detecting an actual size of the selected printing medium; and size check means for acquiring size information of said printing media data corresponding to the selected printing medium from said information storing means in response to a message from said medium select means, and checking if the actual size of the selected printing medium acquired from said size detecting means is coincident with the size information of said printing media data, wherein said printing medium data contains printer setup values, further comprising;

setup means for acquiring the printer setup value corresponding to the selected printing medium from said information storing means in response to a message from said medium selecting means, and setting the printer setup value in said printer.

8. The printing system according to any of claims 1 to 7, wherein said printing medium data includes information on a status of the printing media when a selected printing medium is set in said sheet path, and information on a status of a printing of the selected printing medium when the printing medium is set in the sheet path in a predetermined condition.

9. The printing system according to any of claims 1 to 7, wherein said printer includes said information storing means.

10. The printing system according to any of claims 1 to 7, further comprising at least one host computer bidirectinally communicable with said printer, and said host computer includes said information visual presenting means.

11. The printing system according to claims 1 to 7, wherein said printer includes said medium select means.

12. A program media having a program for a host computer in a printing system, said printing system including a printer with a plurality of sheet paths for receiving printing media, and an information storing means for storing means for storing printing media set in said sheet paths and names of the printing media, wherein said program media contains a computer readable program media for causing said host computer to operate as information visual presenting means for visually presenting the printing media and the names of the printing media, both being registered is said information storing means, and as medium select means for selecting a printing medium to be used for printing from among the printing media set in said sheet paths of said printer in response to a medium select instruction issued by a user, and sends information of said selected printing medium to said printer, wherein a user selects the printing medium without visualizing the printer or manually changing printer setup values associated with the selected printing medium.

13. A printing system including a printer with a plurality of sheet paths for receiving a form sheet, and a host computer, comprising:

a form sheet memory for storing form sheet data;

a register for registering the form sheet data in said form sheet memory; and a monitor for displaying the form sheet data and a corresponding form sheet name, wherein the form sheet is one of a plurality of various form sheets having different form sheet data, and wherein a user selects one of the plurality of various form sheets for printing without visualizing the printer and manually changing printer setup values associated with the selected form sheet.

14. A printing system according to claim 13, wherein said form sheet data includes at least one of a form sheet number, a form sheet path, a form sheet size, printer setup values, the form sheet name and a current selection status.

15. A printing system according to claim 13, further comprising a program having a form sheet data registration mode for registering said form sheet data, a form select mode for selecting the form sheet and a print mode for performing a printing process.

16. A printing system according to claim 15, wherein said form select mode of said program reads out said form sheet data from said register, displays said form sheet data on said monitor for a user to select a form sheet, sends an instruction to the printer wherein said instruction contains a selected form sheet selected by a user, and instructs a printer checker to receive said instruction, wherein said printer checker loads said selected form sheet to said register.

17. A printing system according to claim 15, wherein said form sheet data registration mode of said program sends new form sheet data entered by a user to the printer and instructs said register to register the new form sheet data into said form sheet memory.

18. A printing system including a printer with a plurality of sheet paths for receiving a form sheet, and a host computer, comprising:

a form sheet memory for storing form sheet data;

a register for registering the form sheet data in said form sheet memeory; and a monitor for displaying the form sheet data and a corresponding form sheet name, wherein the form sheet is one of a plurality of various form sheets having different form sheet data, and wherein a user selects one of the plurality of various form sheets for printing without visualizing the printer and manually changing printer setup values associated with the selected form sheet wherein said form sheet data includes at least one of a form sheet number, a form sheet path, a form sheet size, printer setup values, the form sheet name and a currect status, wherein the form sheet path includes at least one of a front manual insertion tray, a rear manual insertion tray, a first cut sheet feeder bin, a second cut sheet feeder bin, a front continuous form tractor, and a rear continuous form tractor.

* * * * *